US007975752B2

(12) United States Patent
Wagstaff

(10) Patent No.: US 7,975,752 B2
(45) Date of Patent: Jul. 12, 2011

(54) CO-CASTING OF METALS BY DIRECT CHILL CASTING

(75) Inventor: Robert Bruce Wagstaff, Greenacres, WA (US)

(73) Assignee: Novelis Inc., Toronto, Ontario (CA)

( * ) Notice: Subject to any disclaimer, the term of this patent is extended or adjusted under 35 U.S.C. 154(b) by 388 days.

(21) Appl. No.: 12/072,029

(22) Filed: Feb. 21, 2008

(65) Prior Publication Data

US 2008/0202720 A1 Aug. 28, 2008

Related U.S. Application Data

(60) Provisional application No. 60/904,212, filed on Feb. 28, 2007.

(51) Int. Cl.
*B22D 11/00* (2006.01)

(52) U.S. Cl. ..... 164/461; 164/419

(58) Field of Classification Search ..... 164/461, 164/419

See application file for complete search history.

(56) References Cited

U.S. PATENT DOCUMENTS

| | | | |
|---|---|---|---|
| 3,206,808 | A | 9/1965 | Robinson |
| 3,353,934 | A | 11/1967 | Robinson |
| 3,421,569 | A | 1/1969 | Neumann |
| 3,911,996 | A | 10/1975 | Veillette |
| 4,030,536 | A | 6/1977 | Rodenchuk et al. |
| 4,449,568 | A | 5/1984 | Narasimham |
| 4,498,521 | A | 2/1985 | Takeda et al. |
| 4,567,936 | A | 2/1986 | Binczewski |
| 4,598,763 | A | 7/1986 | Wagstaff et al. |
| 4,828,015 | A | 5/1989 | Takeuchi et al. |
| 5,526,870 | A | 6/1996 | Odegård et al. |
| 5,947,184 | A | 9/1999 | Steen et al. |
| 6,158,498 | A | 12/2000 | Wagstaff |
| 6,224,992 | B1 | 5/2001 | Delbeke et al. |
| 6,260,602 | B1 | 7/2001 | Wagstaff |
| 6,705,384 | B2 | 3/2004 | Kilmer et al. |
| 6,848,233 | B1 | 2/2005 | Haszler et al. |
| 2002/0192493 | A1 | 12/2002 | Magnusen et al. |
| 2003/0062143 | A1 | 4/2003 | Haszler et al. |
| 2005/0011630 | A1 | 1/2005 | Anderson et al. |

(Continued)

FOREIGN PATENT DOCUMENTS

| | | |
|---|---|---|
| DE | 844 806 | 7/1952 |

(Continued)

OTHER PUBLICATIONS

Patent Abstracts of Japan, vol. 008, No. 174 (M-316), Aug. 10, 1984 & JP 59 066962 A (Mitsubishi Jukogyo KK; others 01), Apr. 16, 1984 abstract; figures 1-5.

(Continued)

*Primary Examiner* — Kuang Lin
(74) *Attorney, Agent, or Firm* — Cooper & Dunham LLP

(57) ABSTRACT

Apparatus and method of co-casting metal ingots in direct-chill casting apparatus. The apparatus and method employs at least one divider (divider member or divider wall) that separates a casting mold into two or more chambers for receiving molten metal that is combined into a single ingot. The divider may be moved, angled and/or flexed during casting to produce ingots that are designed primarily for rolling into thin plate or sheet. The ingot has at least one outer layer that is thicker adjacent to the side (width) edges than in the center, and/or thicker adjacent to the butt or head regions. This compensates for wiping of the outer layer from the ingot core during rolling. Also, the divider may be outwardly bowed outwardly towards one of the mold walls during the casting run.

9 Claims, 6 Drawing Sheets

U.S. PATENT DOCUMENTS

| | | | |
|---|---|---|---|
| 2006/0185816 | A1 | 8/2006 | Anderson et al. |
| 2007/0215312 | A1 | 9/2007 | Gallerneault |
| 2007/0215313 | A1 | 9/2007 | Wagstaff |
| 2008/0008903 | A1 | 1/2008 | Bull et al. |

FOREIGN PATENT DOCUMENTS

| | | | |
|---|---|---|---|
| DE | 44 20 697 | A1 | 12/1995 |
| EP | 0 189 313 | A2 | 7/1986 |
| EP | 0 219 581 | B1 | 4/1987 |
| EP | 0 636 440 | A1 | 2/1995 |
| FR | 2835455 | A1 | 8/2003 |
| GB | 856 424 | A | 12/1960 |
| GB | 1174764 | | 12/1969 |
| GB | 1184764 | | 3/1970 |
| GB | 1266570 | A | 3/1972 |
| GB | 2003556 | A | 3/1979 |
| GB | 2204518 | A | 11/1988 |
| JP | 55-68156 | A | 5/1980 |
| JP | 61-276746 | A | 12/1986 |
| JP | 6-297092 | A | 10/1994 |
| SU | 451496 | | 1/1975 |
| SU | 1447544 | A1 | 12/1988 |
| WO | WO 03/006697 | A1 | 1/2003 |
| WO | WO 03/035305 | A1 | 5/2003 |
| WO | WO 2004/112992 | A2 | 12/2004 |
| WO | WO 2006/053701 | A2 | 5/2006 |

OTHER PUBLICATIONS

Patent Abstracts of Japan, vol. 1996, No. 10, Oct. 31, 1996 & JP 08 164469 A (Nikko Kinzoku KK; Fuji Electric Co Ltd), Jun. 25, 1996 abstract; figures 1-3.

Patent Abstracts of Japan, vol. 0041, No. 8 (M-024), Aug. 5, 1980, JP 55 068156 A, "Production of Slab for Clad Steel Plate in Continuous Casting Method", Oct. 19, 2004.

Database WPI Week 198940, Derwent Publications Ltd., 291528, XP002301665, Kolpakov S.V. et al., "Method of Continuous Casting of Bimetallic Ingots", abstract.

Solidification Characteristics of Aluminum Alloys, vol. 3: Dendrite Coherency, Lars Arnberg, Department of Metallurgy, The Norwegian Institute of Technology, Trondheim, Norway and Lennart Bakerud, Guocai Chai, Department of Structural Chemistry, University of Stockholm, Sweden, American Foundrymen's Society, Inc., 1996, pp. 7-11.

Simultaneous Casting of Alloy Composites, G.J. Binczewski and W.K. Kramer, Light Metals 1972, Proceedings of Sessions, 101st AIME Annual Meeting, San Francisco, California, Feb. 20-24, 1972, pp. 465-481.

Canadian International Property Office, International Search Report mailed Jun. 6, 2008, International application No. PCT/CA2008/000332.

CO-CASTING OF METALS BY DIRECT CHILL CASTING

CROSS-REFERENCE TO RELATED APPLICATIONS

This invention claims the priority right of patent application Ser. No. 60/904,212 filed on Feb. 28, 2007 by applicants herein.

BACKGROUND OF THE INVENTION (1) Field of the Invention

This invention relates to the casting of metals, particularly aluminum and aluminum alloys, by direct chill casting techniques. More particularly, the invention relates to the co-casting of metal layers by direct chill casting.

(2) Description of the Related Art

Metal ingots are commonly produced by direct chill (DC) casting of molten metals in which a molten metal is poured into a mold having an open upper end and (after start-up) an open lower end. The metal emerges from the lower end of the mold as a metal ingot that descends as the casting operation proceeds. In other cases, the casting takes place horizontally, but the procedure is essentially the same. Such casting techniques are particularly suited for the casting of aluminum and aluminum alloys, but are suitable for the casting of other metals as well.

Casting techniques of this kind are discussed extensively in U.S. Pat. No. 6,260,602 to Wagstaff, which relates exclusively to the casting of monolithic ingots, i.e. ingots made of the same material throughout cast as a single layer or ingot. Apparatus and methods for casting layered structures by DC casting are disclosed, for example, in U.S. Pat. No. 6,705,384 to Kilmer et al., issued Mar. 16, 2004, and in U.S. Patent Publication No. 2005/0011630 A1 to Anderson et al., published on Jan. 20, 2005. The Kilmer et al. patent makes use of a metallic divider member suspended in a direct-chill mold. The divider member separates the mold into two chambers that may be supplied with different molten metals, and the member becomes part of the ingot as the molten metal freezes. Consequently, the divider member is continuously fed into the mold through the entry end as the casting operation progresses so that part of the divider member is always present in the mold to keep the molten metal pools separated from each other. In contrast, the Anderson et al. publication employs so-called sequential solidification which requires the casting of a first layer (e.g. a core ingot) and allowing it to cool to the extent that it forms a solid (or at least semi-solid) outer surface, and then, subsequently but in the same casting operation, casting one or more layers of other metal on the solidified surface of the first metal layer. This can be achieved by providing a cooled divider wall at the entrance of the mold to divide the mold entrance into two chambers for receiving feeds of different molten metals. The divider wall remains in place during the casting operation and does not become incorporated into the solidified ingot. The length of the divider wall (in the axial direction of the mold) is long enough to permit the first layer to form its solid shell before it comes into contact with molten metal forming additional layers. The disclosures of the Wagstaff, Kilmer et al. and Anderson et al. references are specifically incorporated herein by this reference.

Ingots produced by both of these co-casting techniques, i.e. the use of a continuously supplied divider member that becomes incorporated into the ingot, and the provision of a cooled divider wall, may suffer from certain disadvantages, especially when intended for subsequent rolling into sheet products, such as brazing strip. One problem is that a relatively thin coating layer formed on a thicker core ingot may be "wiped off" during rolling at the leading and trailing ends of the ingot (i.e. at the ingot head and butt ends), and also at the width sides of the ingot. These phenomena are referred to, respectively, as head-, butt- and edge-wiping, and involve a squeezing of the metal of the coating layer beyond the ends or sides of the ingot at the points where localized rolling pressures may be higher than those over the remainder of the ingot. Another problem is that, because the ingot is subjected to different cooling dynamics during the main stage of the casting operation than at the start and end of casting, so that the cooling ingot is subjected to different rates of contraction in these stages, the interface between the layers may become non-planar in the final cast ingot. This may cause differences of thickness of the coating layer after rolling.

There is therefore a need for improvements to casting apparatus and methods of this kind.

BRIEF SUMMARY OF THE INVENTION

An exemplary embodiment of the invention provides an apparatus for casting a composite metal ingot, comprising: an open-ended generally rectangular mold cavity having an entry end portion, a discharge end opening, and a movable bottom block adapted to fit within the discharge end and to move axially of the mold during casting, said mold cavity having opposed side walls and opposed end walls adapted to cast a rectangular composite ingot having opposed faces and opposed ends; a divider positioned in said mold cavity and extending across the cavity towards opposite end walls thereof, thereby dividing at least the entry end portion of the mold cavity into first and second feed chambers; a first molten metal feed arrangement for feeding molten metal for a first layer of said composite ingot to one of said feed chambers; and a second molten metal feed arrangement for feeding molten metal for a second layer of said composite ingot to said second feed chamber; wherein said divider has a central part and two opposite end parts, said end parts being oriented relative to said central part such that said second layer of said composite ingot emerging from said discharge end of said mold cavity has end regions adjacent to said opposed ends of said ingot of greater thickness than a central region positioned between said end regions.

Another exemplary embodiment provides an apparatus for casting a composite metal ingot, comprising: an open-ended generally rectangular mold cavity having an entry end portion, a discharge end opening, and a movable bottom block adapted to fit within the discharge end and to move axially of the mold during casting, said mold cavity having opposed side walls and opposed end walls adapted to cast a rectangular composite ingot having opposed faces and opposed ends; a longitudinal divider positioned in said mold cavity and extending across the cavity towards opposite end walls thereof, thereby dividing at least the entry end portion of the mold cavity into first and second feed chambers, said divider being flexible in directions towards and away from said opposed side walls of the mold cavity; a first molten metal feed arrangement for feeding molten metal for a first layer of said composite ingot to one of said feed chambers; a second molten metal feed arrangement for feeding molten metal for a second layer of said composite ingot to said second feed chamber; and flexing equipment acting on said divider to produce flexing of at least a central part of said divider towards and away from one of said opposed side walls at different times during casting.

Yet another exemplary embodiment provides an apparatus for casting a composite metal ingot, comprising: an open-ended generally rectangular mold cavity having an entry end portion, a discharge end opening, and a movable bottom block adapted to fit within the discharge end and to move axially of the mold during casting, said mold cavity having opposed side walls and opposed end walls adapted to cast a rectangular composite ingot having opposed faces and opposed ends; a divider positioned in said mold cavity and extending across the cavity towards opposite end walls thereof, thereby dividing at least the entry end portion of the mold cavity into first and second feed chambers; a first molten metal feed arrangement for feeding molten metal for a first layer of said composite ingot to one of said feed chambers; a second molten metal feed arrangement for feeding molten metal for a second layer of said composite ingot to said second feed chamber, and a guide for said divider, said guide being movable, thereby allowing said divider to be moved at times during casting relative to said mold cavity in directions towards or away from one of said side walls of the mold cavity.

Other exemplary embodiments relate to methods of casting for producing ingots as indicated above.

The term "divider" as used in this specification (both in the description and claims) is intended to include any means for dividing an entry portion of a direct chill casting mold into two internal chambers for continuous metal casting. If the divider is in the form of a continuous sheet or plate fed into the mold and intended to become part of the ingot (e.g. as disclosed in Kilmer et al.), it is referred to herein as a "divider member". On the other hand, a divider that is cooled and remains stationary in the mold (e.g. as disclosed in Anderson et al.) is referred to herein as a "divider wall". Of course, the divider may be rigid (as is normally the case for divider walls) or fully or partially flexible (normally more suitable for divider members), at least at the operational temperature of the casting apparatus. The divider may be only movable or only flexible or both movable and flexible. By an appropriate combination of such features, it is possible to produce an ingot having an outer layer that is thicker in any one or all of the head, butt and lateral edge regions to compensate for wiping-off of the peripheral parts of the outer layer during later rolling. It should also be appreciated that, despite such differences in thickness of parts of the outer layer, the overall thickness of the cast ingot is preferably constant throughout (i.e. the thickness of the inner layer is adjusted in such parts to maintain the overall thickness the same).

It is to be noted that that the term "rectangular" as used in this specification is meant to include the term "square", although ingots intended for rolling are generally not square. The term "generally rectangular" includes small variations from the rectangular outline that are common in ingot casting of this kind. For example, contraction may cause ingot walls to be slightly concave. Precise geometrical shapes are often hard to produce, or unnecessary, in casting procedures of this kind, so the reference to "rectangular" or "square" should be interpreted with this in mind.

DETAILED DESCRIPTION OF THE INVENTION

Figure 1:
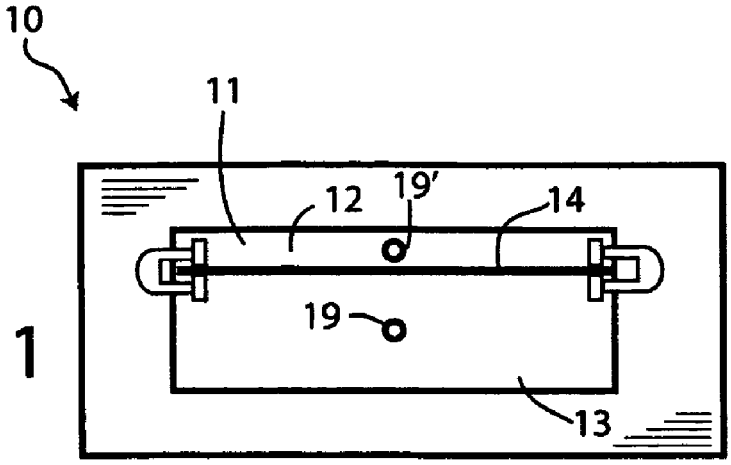
FIG. 1 is a simplified top plan view of a co-casting mold apparatus.
Figure 2:
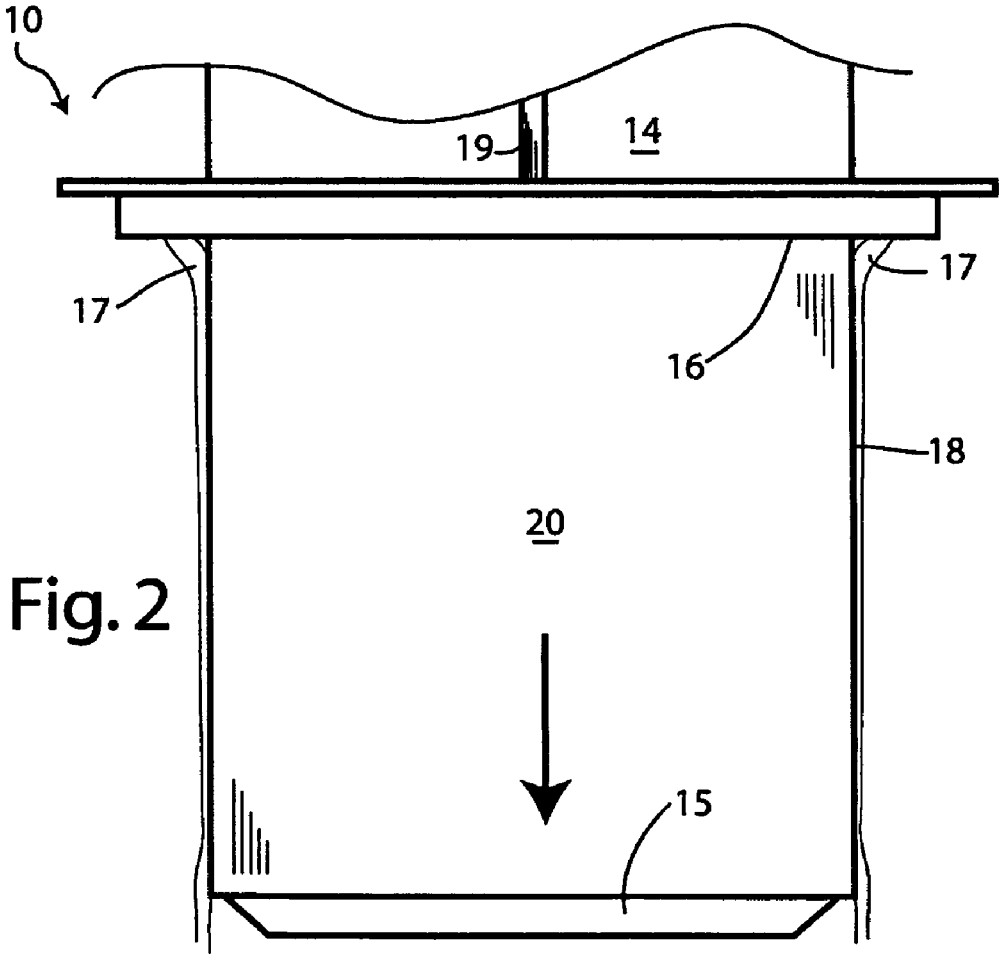
FIG. 2 is a side elevation of the apparatus of FIG. 1, showing the casting of an ingot.

FIGS. 1 and 2 of the accompanying drawings show a modification of the Kilmer et al. casting apparatus referred to above. It will of course be realized by persons skilled in the art that FIGS. 1 and 2 are greatly simplified and that a working version of the apparatus will require additional equipment and structures, all of which will be apparent to a skilled artisan.

Figure 3:
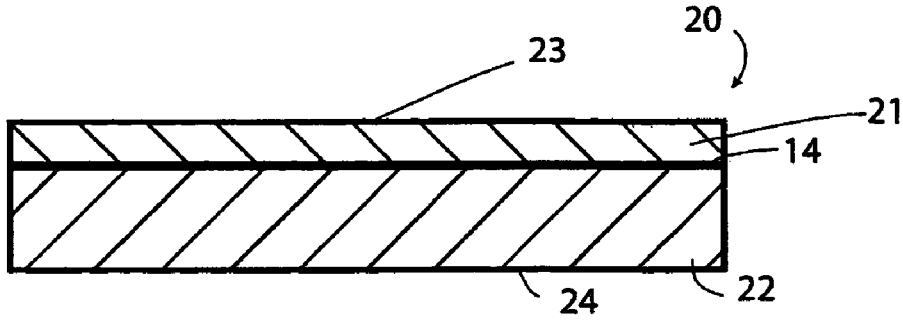
FIG. 3 is a transverse cross-section of an ingot cast according to FIG. 2.
Figure 4:
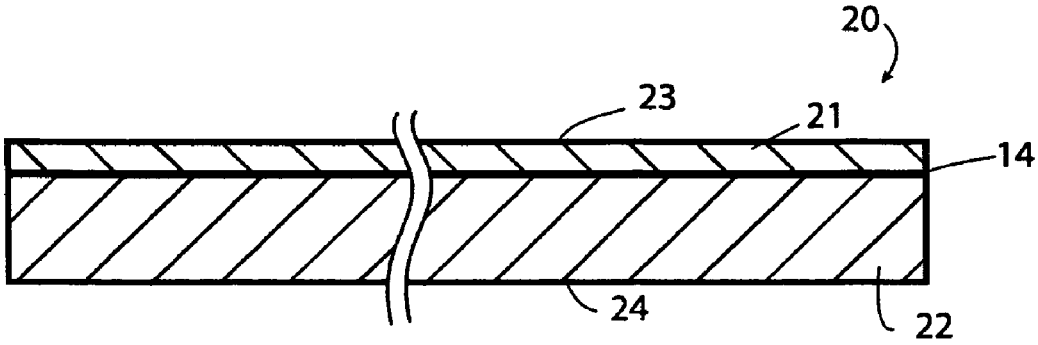
FIG. 4 is a longitudinal cross-section of an ingot cast according to FIG. 2.

FIGS. 1 and 2 show a rectangular direct-chill casting mold 10 having a mold cavity 11 which is divided into two mold chambers (i.e. metal feed chambers) 12 and 13 by a vertical divider member 14. The divider member 14 may be attached to a bottom block 15, which is positioned at a discharge end opening (i.e. an outlet) 16 of the mold cavity during start-up and is fed into the mold from above by a supporting and feed apparatus (not shown). The divider member 14 may be made of a suitable metal, e.g. aluminum, an aluminum alloy, or a clad aluminum product that preferably has a solidus temperature greater than the liquidus temperature of the molten alloys fed to the chambers via supply tubes 19 and 19', or equivalent metal supply apparatus such as launders, and cast on either side of the divider member in the chambers 12 and 13. As the bottom block 15 descends during casting, cooling water 17 is directed onto the outer surface 18 of the emerging ingot 20 in order to cool this surface of the ingot as quickly as possible. As noted earlier, the divider member 14 becomes incorporated into the ingot as the ingot solidifies. If desired, more than one divider member 14 may be provided within the mold cavity in order to create an ingot consisting of more than two layers. A horizontal cross-section of an ingot produced according to the equipment of FIGS. 1 and 2 incorporating a single divider member 14 is shown in FIGS. 3 and 4 (FIG. 3 being a transverse cross-section and FIG. 4 being a longitudinal cross-section through the same ingot). The ingot has two distinct layers 21 and 22 of solidified metal separated by divider member 14 incorporated into the solid structure. It should be appreciated that one of the layers, e.g. layer 21, is intended only as a cladding and may thus be much thinner than represented here.

It will be seen that the divider member 14 is essentially planar so that the metal layers on each side are of constant thickness at all points between the divider member 14 and the respective rolling face 23 or 24 of the metal layers, both in the transverse and in the longitudinal directions. While this kind of structure is desirable in certain applications, most ingots produced in this way are intended for rolling into sheet or plate of reduced thickness compared to the ingot itself. This involves passing the ingot several times through a rolling mill and there is a tendency for a thinner surface layer 21 (cladding) to be "wiped off" an inner layer 22 (core) towards the ends and the edges of the ingot where pressures exerted by rollers may be significantly increased compared to the remaining area of the ingot structure. The resulting thinning of the cladding layer in the rolled structure can result in significant wastage because the parts of the rolled sheet or plate product not having a required thickness of coating may have to be trimmed off and discarded.

Figure 5:
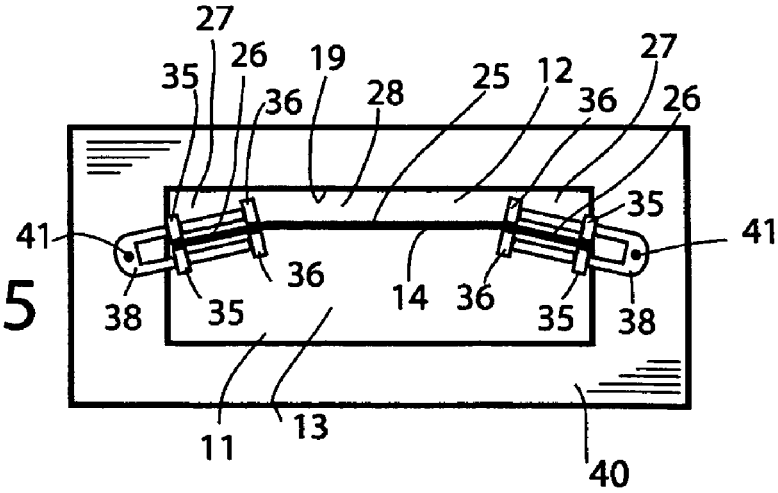
FIG. 5 is a top plan view similar to FIG. 1, but showing end-angling of a divider member used in the casting operation.
Figure 6:
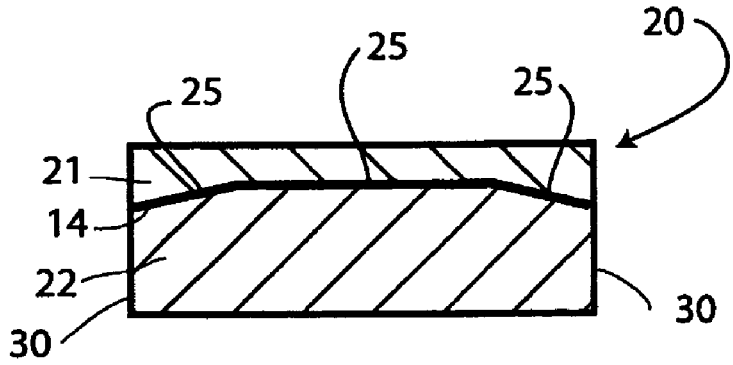
FIG. 6 is a transverse cross-section of an ingot cast according to FIG. 5.

The disadvantage of layer thinning at the transverse edges (width edges) of the rolled structure is addressed by the arrangement shown in FIGS. 5 and 6. The embodiment illustrated in these figures makes use of the relative flexibility of the divider member 14 caused by the relative thinness of this member and the fact that it becomes heated to a relatively high temperature (e.g. 500 to 600° C. or more) immediately in advance of the mold cavity 11 because of heat conducted along the divider member from the part already incorporated into the hot ingot. This allows the divider member 14 to be provided with the profile as shown in the top plan view of FIG. 5, i.e. having a central part 25 of the member that remains essentially planar, and opposite end parts 26 that are bent or angled relative to the central part in such a manner that one of the chambers of the mold (chamber 12) has end regions 27 of increased spacing between the divider member 14 and the adjacent side wall 19, whereas the other chamber 13 has end regions of reduced spacing relative to the distance between the divider member and the opposite side wall in the end regions of the mold cavity. The chamber with the increased spacing is generally intended for the overall thinner cladding layer of the resulting ingot, consequently the ingot thus formed (shown in exaggerated form in transverse cross-section in FIG. 6) has a thinner layer 21 with increased thickness in the region of the lateral edges (width edges) 30 of the ingot. The ingot 20 is of constant total thickness throughout, so the increase in thickness of the cladding layer 21 in the region of the lateral ends 30 of the ingot is compensated for by a reduction in thickness of the core layer 22.

During rolling of an ingot of this structure, the increased thickness of the cladding layer at the lateral edges of the ingot compensates for the loss of the material of this layer caused by "edge-wipe" and thereby reduces or eliminates the need for waste-causing edge-trimming of resulting sheet or plate products. The profile of the divider member is preferably kept constant throughout the entire casting operation to produce a cast ingot having a cladding layer with side edges of increased thickness along the entire length of the ingot. The positions where the ends 26 of the divider member are bent out of the plane of the central section 25, and the angle of the bend in these positions, is of course chosen to cause the thickness of the coating layer to be as uniform as possible in the direction from one lateral side edge to the other in the finished rolled plate or sheet product. Generally, the angle between the ends and central part (i.e. the angle by which the end parts deviate from the planar position) is no more than 30°, and more preferably 15 to 25°. The lengths of the angled ends, in an ingot having a width of 69 inches (753 mm), may be, for example, up to 15 inches (381 mm). The length and angle may have to be varied according to the inherent properties of the metals being cast (particularly the properties of the metal used for the outer layer), the pressures employed during rolling, and the ultimate thickness of the sheet or plate products as well as the cast ingot. However, the required length and thickness for each case can be obtained empirically by carrying out test casts and rollings, or theoretically based on knowledge of the materials involved and the rolling pressures employed. For example, when using aluminum alloy AA4045 as the metal of the outer layer for an ingot, the ingot dimensions may be as follows:

| | | |
|---|---|---|
| Ingot width: | 69 | inches (753 mm) |
| Ingot thickness: | 27.63 | inches (702 mm) |
| Length of cast ingot: | 185 | inches (4,699 mm) |
| Thickness of outer layer: | 3.01 | inches (77 mm) |
| Length of each angled part of divider member: | 15 | inches (381 mm) |
| Angle of each angled part of divider member: | 25°. | |

A shown in FIG. 5, the required bending of the divider member 14 can be achieved by passing the divider member between two opposed sets of rollers 35, 35 and 36, 36 supported on carriages 38 attached to the top surface 40 of the mold or by other supporting structure. If desired, instead of using two sets or rollers, a single set of elongated rollers covering the entire length of end parts 26 may be used instead, or any equivalent guiding means. If the carriages 38 are pivotable about pivots 41, the angle of the bend in the divider member may be changed and the carriages then clamped against further rotation, thereby making it possible to produce ingots having different edge thicknesses. This may be suitable for casting different combinations of metals in different casting operations.

Figure 7:
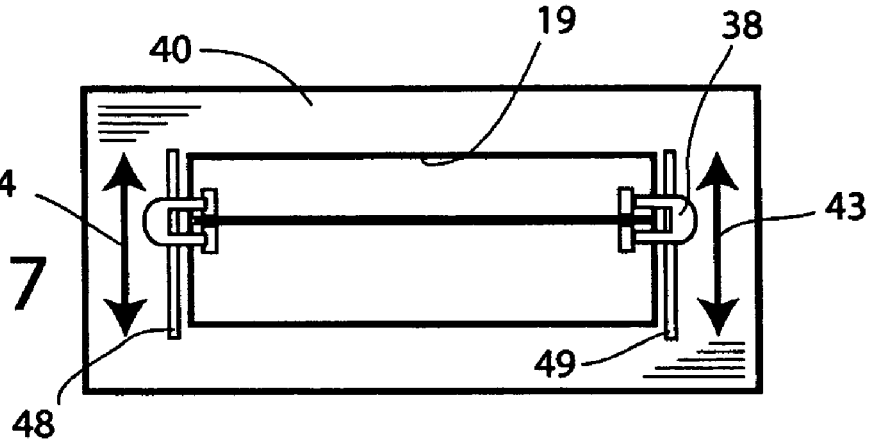
FIG. 7 and FIG. 8 are top plan views of a casting apparatus showing equipment that allows the divider member to be moved towards (FIG. 8) or away from (FIG. 7) a side wall of the mold.
Figure 8:
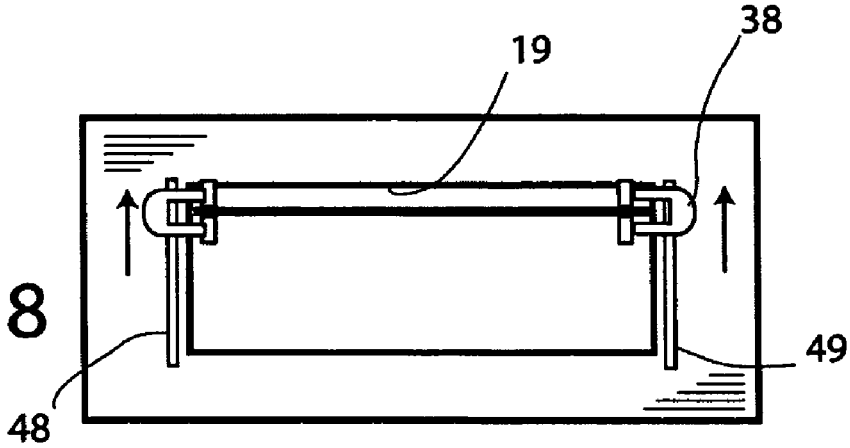
Figure 9:
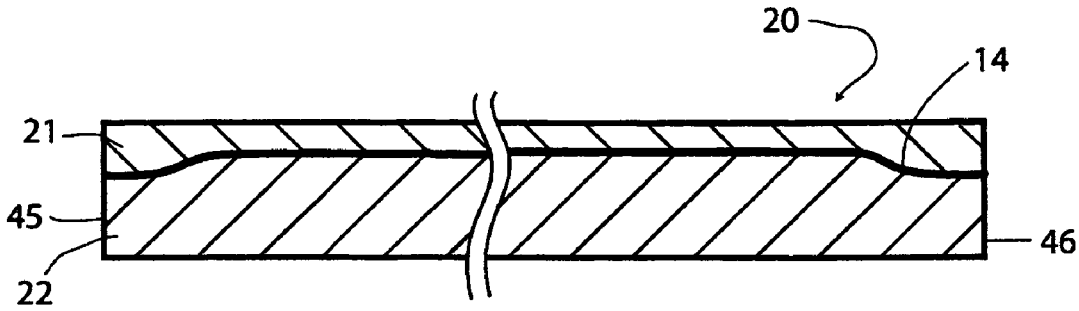
FIG. 9 is a longitudinal cross-section of an ingot cast according to FIGS. 7 and 8.

As noted above, as well as lateral edge-wiping, so-called head- and butt-wiping may also be experienced during rolling, i.e. loss of cladding metal at the longitudinal ends (head and butt) of a product rolled from an ingot. Suitable compensation for this metal loss can be provided according to the apparatus shown in FIG. 7. This shows a casting mold similar to that of FIG. 1, but the guiding apparatus for the divider member 14 is movable in the manner shown by the double-headed arrows 43 and 44 to slide from a position more distant from side wall 19 of the mold (FIG. 7), or closer to it (FIG. 8). This move can be made during a casting operation, for example so that the divider member 14 is moved further away from side wall 19 during the start phase of casting and also during the end phase of casting, and then moved towards the sidewall 19 for the remainder of the cast (referred to as the "run"). During the times when the divider member is moved in this way, the part immediately above the metal is kept planar and does not change in shape or flex significantly. As the divider member is moved from one position to the other, the part entering and descending through the molten metal undertakes a smooth curve before becoming embedded in the solidified metal of the cast ingot. At other times, the divider member is kept planar throughout the cast. This produces an ingot as shown in simplified form in FIG. 9, which is a longitudinal cross-section of an ingot produced in this way. As shown in the figure, the cladding layer 21 is thicker at the head 45 and butt 46 of the ingot to compensate for metal loss due to wiping of the cladding layer at these locations.

Once again, the positions at which the divider member 14 is moved during casting depends on the metals being cast (particularly the metal and thickness of the cladding layer) and can be determined empirically or by calculation. The objective, of course, is to produce a rolled plate or sheet product having a cladding layer with a constant thickness along the entire length the length of the ingot. For example, when using alloy AA4045 as the cladding material for an ingot dimensioned as above, the divider member may be moved at positions approximately 20 inches (508 mm) from the head and the butt ends. The extent by which the divider member is moved again depends on the product being cast, but may represent up to 17% of the thickness of the cladding layer produced during the casting run. However, increases of less than 5%, or even less than 2%, may be satisfactory, depending on the properties desired.

The desired movability of the guiding apparatus 38 can be provided by mounting the guiding apparatus 38 on rails 48 and 49 positioned at the top surface 40 of the mold and moved by a suitable motor, e.g. a linear drive or worm gear (not shown). Once again, the flexibility of the divider member makes this movement possible, as explained above.

Figure 10:
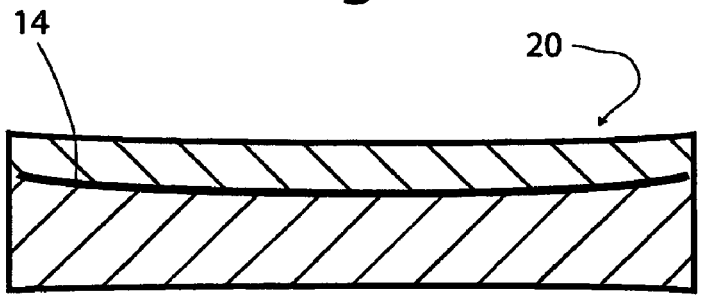
FIG. 10 is a transverse cross-section of an ingot of a metal having a high coefficient of contraction cast according to FIG. 1.

In some circumstances, for example with a particular combination of metals used for the core and cladding layers, it may be desirable to provide the divider member 14 with a suitable curve or arch (as seen in a top plan view), at least during a particular stage of the casting procedure, either over the entire width of the divider member or at least in the central part 25 when using the apparatus of FIG. 5. This is because contraction of the core layer during solidification and cooling may cause the metal to contract more at the center of a rolling face than in a region near the lateral edges. This contraction will, in turn, cause the cladding layer to follow the contraction of the core layer and may produce an ingot having a cladding layer with a greater thickness at the center of a rolling face than at the lateral edges. Indeed, the entire ingot may have a rolling face that is dished in this way. FIG. 10 shows an ingot of this kind in exaggerated form (shown as a cross-section at a position intermediate the head and butt) produced from a rectangular mold and provided with a divider member 14 initially introduced into the mold in planar form.

Figure 11:
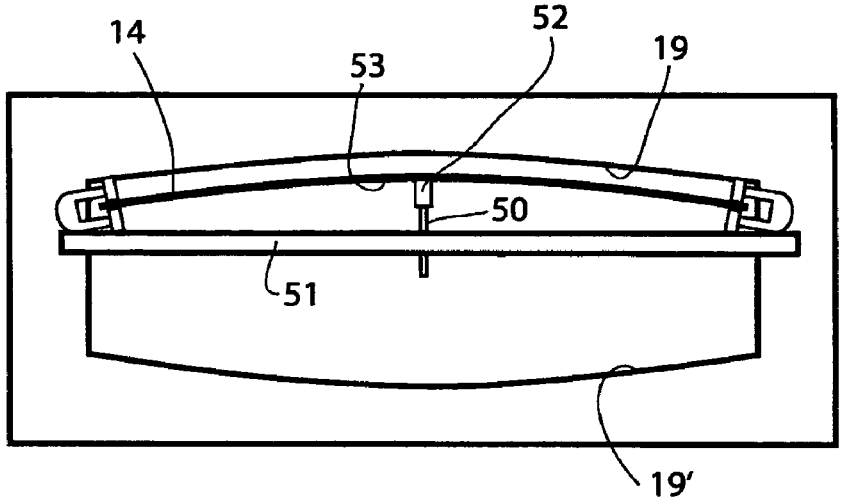
FIG. 11 is a top plan view of a mold apparatus (operated during the main stage of casting) with equipment to avoid the curve in the divider member shown in FIG. 10.
Figure 12:
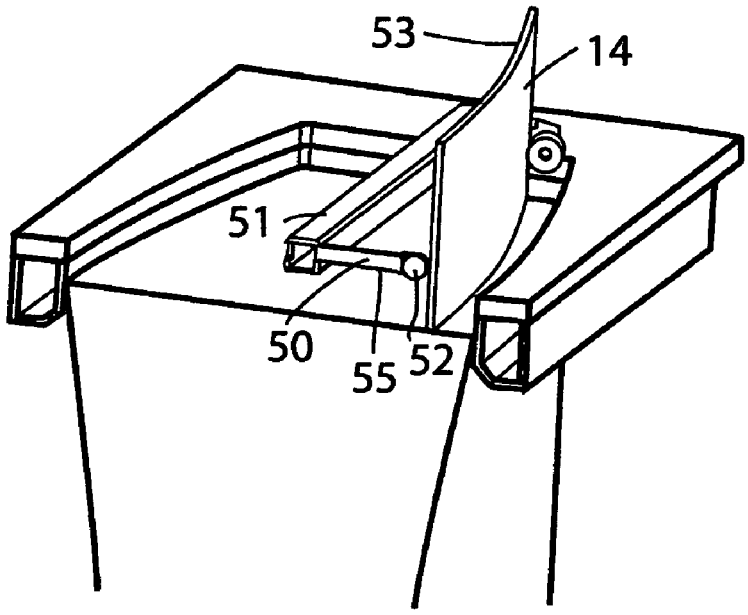
FIGS. 12 and 13 are cross-sections, partly in perspective, of apparatus similar to that of FIG. 12, showing a divider member caused to take on a curve (FIG. 12) or allowed to retain a planar arrangement (FIG. 13)
Figure 13:
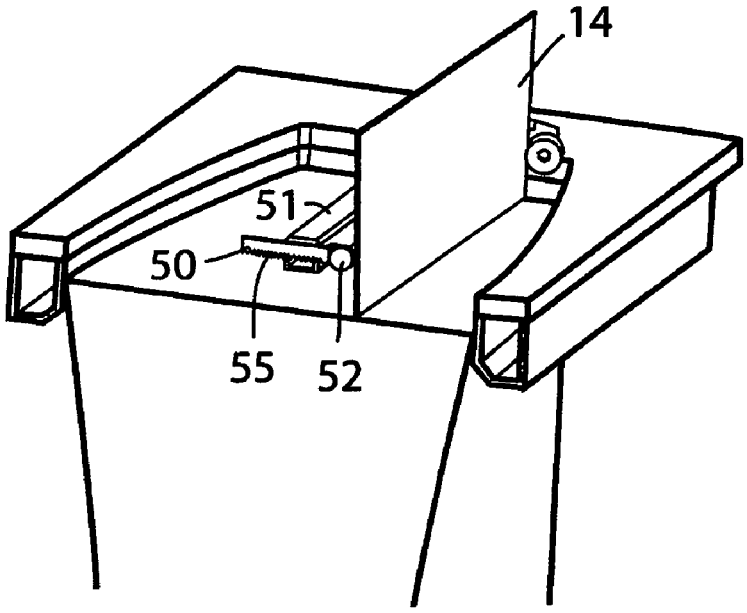

To compensate for such contraction issues, the divider member 14 may be outwardly curved as it is fed into the mold so that, upon solidification of the ingot, the divider member adopts a more planar configuration. This can be achieved, for example, by employing apparatus as shown in FIGS. 11 and 12 wherein a pusher rod 50 is movably mounted on a cross-brace 51 and has a roller 52 at its outer end that bears against a surface 53 of the divider member 14 at the center thereof. During casting, the ingot experiences greater cooling at the start and at the end of the casting procedure and solidification of the metal is more rapid at those times. Because of this, contraction forces have less distance over which to act and less time to act on the metal of the core layer, so there is less of a tendency for the core layer to be pulled in at the center during these initial and end phases. Therefore, during the start and end of casting, the divider member may be allowed to adopt a planar configuration, as shown in FIG. 13. During steady state casting (the casting run) between the start and end phases, however, the divider member 14 is provided with a convex configuration by movement of the pusher rod 50 to the position shown in FIGS. 11 and 12. The pusher rod 50 may be driven by any suitable motor (not shown), e.g. via a pinion (not shown) acting on a rack 55 cut into the underside of the pusher rod as shown in FIGS. 12 and 13. As with the other embodiments referred to above, the degree to which the divider member is made convex can be determined empirically or by calculation with the goal of allowing the divider member to return to the planar configuration in the solidified ingot. Generally, however, the curved part may represent 10% or less of the total thickness of the cladding layer, and generally 5-7%. It will be noticed in FIGS. 11 to 13 that the sidewalls 19, 19' of the casting mold are themselves outwardly bowed to compensate for contraction of the rolling faces of the resulting ingot with a view to producing an ingot that is close to rectangular (planar rolling faces) after casting and cooling.

Figure 14:
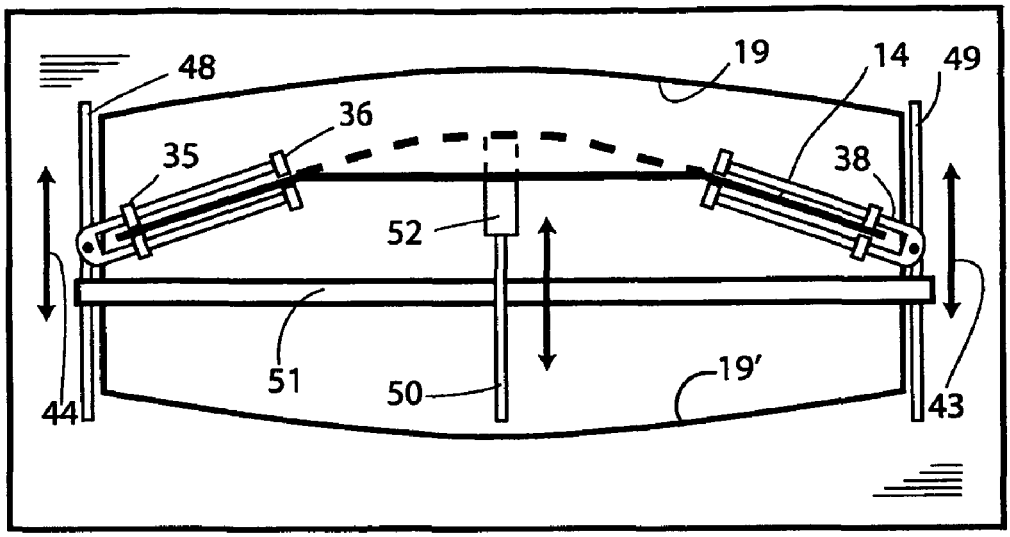
FIG. 14 is a top plan view of a casting mold apparatus showing equipment to cause a divider member to have angled end portions and a central portion that may be allowed to be planar (solid lines) or caused to adopt an outward curve (broken lines)

FIG. 14 shows a casting mold provided with a combination of the features described earlier. This is achieved by providing both the roller arrangements 35, 36 of FIG. 5, the movable carriages 38, 43, 44 of FIG. 7, and the movable pusher 50, 52 of FIGS. 11 to 13. An arrangement of this kind is able to compensate for all of the following deficiencies of conventional co-casting of this kind, namely:

thinning of a cladding layer due to lateral edge-wipe during rolling;

thinning of a cladding layer at the head and butt of an ingot due to head- and butt-wiping during rolling;

concavity of the interface between a core layer and a cladding layer at a central part of an ingot due to metal contraction in the casting run; and concavity of the rolling faces of the ingot due to metal contraction in the casting run.

Figure 15:
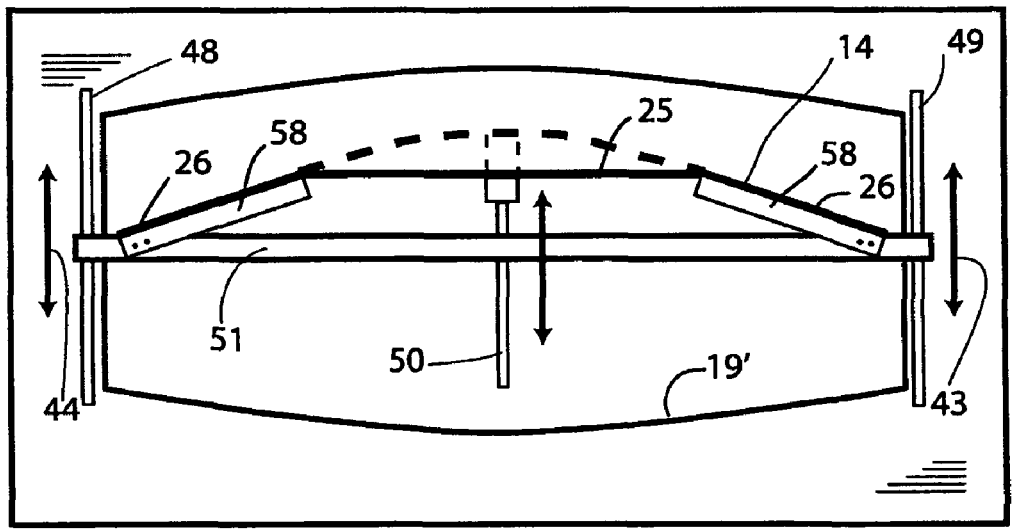
FIG. 15 is a view similar to that of FIG. 14 of an embodiment having a divider wall for sequential co-casting rather than a divider member that becomes embedded in the ingot.

When employing sequential casting apparatus of the kind disclosed by Anderson et al., a fixed divider wall is used rather than an elongated flexible divider member that is incorporated into the ingot. As the divider wall remains within the entry portion of the mold, there is no need for the guide rollers shown in the earlier embodiments provided to guide and support the divider member as it moves downwardly through the mold in concert with the casting of the ingot. FIG. 15 is a view equivalent to FIG. 14, but of an embodiment having a cooled divider wall. The divider wall 14 itself may be flexible, but the end sections 26 are firmly held by supporting bars 58 positioned at the upper end of the divider wall. The central section 25 has no such support, and is therefore free to move between a planar shape and an arched shape (shown in broken lines) as described previously with respect to FIG. 14. As is also the case for the embodiment of FIG. 14, the divider wall 14 may be mounted on rails 48, 49 or the like so that it may be moved backwards and forwards as shown by the double headed arrows 43 and 44, thereby allowing for increased thickness of the coating layer at the head and butt regions of the ingot. In this way, casting apparatus incorporating a divider wall and supports 58 may be made to operate in the same way as any of the embodiments of FIG. 3 to 14 and essentially the same details apply.

The invention claimed is:

1. Apparatus for casting a composite metal ingot, comprising:

an open-ended generally rectangular mold cavity having an entry end portion, a discharge end opening, and a movable bottom block adapted to fit within the discharge end opening and to move axially of the mold during casting, said mold cavity having opposed side walls and opposed end walls adapted to cast a rectangular composite ingot having opposed faces and opposed ends;

a cooled divider wall that remains within an entry end portion of said mold cavity and extends across the cavity towards opposite end walls thereof, thereby dividing at least the entry end portion of the mold cavity into first and second feed chambers;

a first molten metal feed arrangement for feeding molten metal for a first layer of said composite ingot into one of said feed chambers;

a second molten metal feed arrangement for feeding molten metal for a second layer of said composite ingot into said second feed chamber; and which includes end supports for said cooled divider wall, said support being movable, thereby allowing said divider wall to be moved as a whole through moving said support at times as casting proceeds relative to said mold cavity in directions towards or away from one of said side walls of the mold cavity.

2. Apparatus according to claim 1, wherein said divider wall has a central part and two opposite end parts, said end parts being linear and angled relative to said central part such that said second layer of said composite ingot emerging from said discharge end of said mold cavity has end regions adjacent to said opposed ends of said ingot of greater thickness than a central region positioned between said end regions, and wherein said central part of said divider wall is flexible in directions towards and away from said opposed side walls of the mold cavity, and said apparatus includes flexing equipment acting on said central part of said divider wall to allow flexing of a central part of said divider towards and away from one of said opposed side walls of said mold cavity.

3. Apparatus for casting a composite metal ingot, comprising:

an open-ended generally rectangular mold cavity having an entry end portion, a discharge end opening, and a movable bottom block adapted to fit within the discharge end and to move axially of the mold during casting, said mold cavity having opposed side walls and opposed end walls adapted to cast a rectangular composite ingot having opposed faces and opposed ends;

a cooled divider wall that remains within an entry end portion of said mold cavity and extends across the cavity towards opposite end walls thereof, thereby dividing at least the entry end portion of the mold cavity into first and second feed chambers;

a first molten metal feed arrangement for feeding molten metal for a first layer of said composite ingot to one of said feed chambers; and a second molten metal feed arrangement for feeding molten metal for a second layer of said composite ingot to said second feed chamber;

wherein said cooled divider wall has a central part and two opposite end parts, said end parts being linear and angled and held fixed relative to said central part such that said second layer of said composite ingot emerging from said discharge end of said mold cavity has end regions adjacent to said opposed ends of said ingot of greater thickness than a central region positioned between said end regions; and wherein said divider wall is flexible in said central part and said apparatus includes flexing equipment acting on said divider wall to cause said central part to change between planar and curved orientations during said casting without causing flexing of said end parts.

4. The apparatus of claim 3, including a movable support for said divider wall, said support being adapted to move said divider wall as a whole between different positions within said entry end portion of said mold cavity.

5. Apparatus for casting a composite metal ingot, comprising:

an open-ended generally rectangular mold cavity having an entry end portion, a discharge end opening, and a movable bottom block adapted to fit within the discharge end and to move axially of the mold during casting, said mold cavity having opposed side walls and opposed end walls adapted to cast a rectangular composite ingot having opposed faces and opposed ends;

a cooled divider wall that remains within an entry end portion of said mold cavity and extending across the cavity towards opposite end walls thereof, thereby dividing at least the entry end portion of the mold cavity into first and second feed chambers, said divider wall being flexible in a central part thereof in directions towards and away from said opposed side walls of the mold cavity;

a first molten metal feed arrangement for feeding molten metal for a first layer of said composite ingot to one of said feed chambers;

a second molten metal feed arrangement for feeding molten metal for a second layer of said composite ingot to said second feed chamber; and flexing equipment acting on said divider wall to produce flexing of said central part of said divider wall towards and away from one of said opposed side walls;

wherein said divider wall has opposite end parts, one on each side of said central part, said end parts being linear and angled relative to said central part such that said second layer of said composite ingot emerging from said discharge end opening of said mold cavity has end regions adjacent to said opposed ends of said ingot of greater thickness than a central region positioned between said end regions; and wherein said flexing equipment acts only on said central part of said divider wall, said end parts remaining unflexed during casting.

6. A method of casting a metal ingot having an inner metal layer and at least one outer layer, comprising providing a direct chill casting mold having a mold cavity divided into at least two chambers by at least one cooled divider wall that remains within an entry end portion of said mold cavity, separately introducing molten metal into the at least two chambers to produce an ingot having said layers and having a head region, a butt region and a central region, and providing a support which includes end supports for said at least one divider wall wherein said at least one divider wall is moved as a whole through moving said support within said casting cavity at different times as casting proceeds to cause said at least one outer layer to be thicker in said head and butt regions than in said central region.

7. A method of casting a metal ingot having an inner metal layer and at least one outer metal layer, comprising providing a direct chill casting mold having a mold cavity divided into at least two chambers by at least one cooled divider wall, and separately introducing molten metal into the at least two chambers to produce an ingot having said layers, wherein said at least one divider wall has a flexible central part and two opposite end parts, wherein said end parts are linear and angled with respect to said central part during casting and are held to prevent flexing to cause said at least one outer layer to be thicker adjacent to side edges of the ingot than in a center thereof, and wherein said flexible central part is flexed within said casting cavity at different times as casting proceeds.

8. A method of casting a metal ingot having an inner metal layer and at least one outer layer, comprising providing a direct chill casting mold having a mold cavity divided into at least two chambers by at least one flexible divider wall that remains within an entry end portion of said mold cavity, separately introducing molten metal into the at least two chambers to produce an ingot having said layers and having a head region, a butt region and a central region, and providing a support which includes end supports for said at least one divider wall wherein said at least one divider wall is kept substantially planar during casting of said head and butt regions, but is moved as a whole through moving said support within said casting cavity at different times as casting proceeds to cause said at least one outer layer to be thicker in said head and butt regions than in said central region.

9. A method of casting a metal ingot having an inner metal layer and at least one outer layer, comprising providing a direct chill casting mold having a mold cavity divided into at least two chambers by at least one cooled divider wall that remains within an entry end portion of said mold cavity, separately introducing molten metal into the at least two chambers to produce a cast ingot including said layers and having a head region, a butt region, lateral side regions and a central region between said head, butt and end regions, and providing a support which includes end supports for said at least one divider wall, wherein said at least one divider wall is moved as a whole through moving said support and flexed within said casting cavity at different times as casting proceeds to cause said at least one outer layer of said cast ingot to be thicker in at least one of said head region, said butt region, and said end regions than in said central region.

* * * * *